US009057235B2

(12) United States Patent
Blue et al.

(10) Patent No.: US 9,057,235 B2
(45) Date of Patent: Jun. 16, 2015

(54) MONITORING AND CONTROL SYSTEMS FOR CONTINUOUS CIRCULATING DRILLING OPERATIONS

(71) Applicant: BAKER HUGHES INCORPORATED, Houston, TX (US)

(72) Inventors: D. Duncan Blue, Houston, TX (US); Charles A. Brecher, Spring, TX (US); John D. Macpherson, Spring, TX (US); Volker Krueger, Niedersachsen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 234 days.

(21) Appl. No.: 13/718,662

(22) Filed: Dec. 18, 2012

(65) Prior Publication Data

US 2014/0166364 A1 Jun. 19, 2014

(51) Int. Cl.
*E21B 21/08* (2006.01)

(52) U.S. Cl.
CPC ..... *E21B 21/08* (2013.01)

(58) Field of Classification Search
USPC ..... 166/77.51, 90.1, 244.1; 175/25, 38
See application file for complete search history.

(56) References Cited

U.S. PATENT DOCUMENTS

| | | | | |
|---|---|---|---|---|
| 4,315,553 | A | 2/1982 | Stallings | |
| 4,364,587 | A | 12/1982 | Samford | |
| 4,813,495 | A | 3/1989 | Leach | |
| 6,119,772 | A | 9/2000 | Pruet | |
| 6,412,554 | B1 | 7/2002 | Allen et al. | |
| 6,581,692 | B1 | 6/2003 | Koch et al. | |
| 6,591,916 | B1 | 7/2003 | Ayling | |
| 6,688,394 | B1 | 2/2004 | Ayling | |
| 7,107,875 | B2 | 9/2006 | Haugen et al. | |
| 7,188,683 | B2 | 3/2007 | Ayling | |
| 7,350,587 | B2 | 4/2008 | Springett et al. | |
| 7,617,866 | B2 | 11/2009 | Pietras | |
| 8,016,033 | B2 * | 9/2011 | Iblings et al. | 166/244.1 |
| 8,720,545 | B2 * | 5/2014 | Iblings et al. | 166/244.1 |
| 2003/0221519 | A1 | 12/2003 | Haugen | |
| 2008/0060846 | A1 | 3/2008 | Belcher et al. | |
| 2010/0200299 | A1 | 8/2010 | Vatne | |
| 2010/0252272 | A1 | 10/2010 | Haughom | |
| 2013/0068532 | A1 * | 3/2013 | Bansal et al. | 175/218 |
| 2014/0224509 | A1 * | 8/2014 | Yajure et al. | 166/380 |

FOREIGN PATENT DOCUMENTS

| | | | |
|---|---|---|---|
| WO | 2008156376 | A1 | 12/2008 |
| WO | 2012006457 | A1 | 1/2012 |

OTHER PUBLICATIONS

PCT/US2013/076122—International Search Report and Written Opinion dated Apr. 9, 2014.

* cited by examiner

*Primary Examiner* — William P Neuder
(74) *Attorney, Agent, or Firm* — Mossman, Kumar & Tyler, PC

(57) ABSTRACT

An apparatus for continuously flowing drilling fluid along a drill string includes a continuous circulation device having at least a first fluid path in fluid communication with a top drive and a second fluid path in communication with a diverter. The diverter is in selective fluid communication with a pipe stand associated with the drills string. The apparatus also includes at least one sensor that estimates at least one operating parameter associated with the continuous circulation device. A related method includes using a continuous circulation device as described to manipulate the drill string and controlling the continuous circulation device using at least one sensor configured to estimate at least one operating parameter associated with the continuous circulation device.

12 Claims, 5 Drawing Sheets

MONITORING AND CONTROL SYSTEMS FOR CONTINUOUS CIRCULATING DRILLING OPERATIONS

BACKGROUND OF THE DISCLOSURE

1. Field of the Disclosure

This disclosure relates generally to devices, systems, and methods to maintain constant fluid circulation during the drilling of a borehole.

2. Background of the Art

During drilling of boreholes, drilling fluids may be used to stabilize the borehole, cool and lubricate drilling equipment, and to apply a desired pressure to a formation being drilled. During drilling, the drilling fluid is circulated continuously. Conventionally, when a new section of drill pipe is connected to or disconnected from the top of a drill string, the circulation of drilling fluid is stopped. When circulation stops, the drilling fluid may settle and increase in viscosity. Thus, the drilling fluid circulation pumps may have to overcome a pressure increase to re-start circulation. Moreover, some formations may have relatively narrow margins between fracturing gradient and pore pressure. Maintaining pressure on the formation within these margins may be challenging during interruptions in drilling fluid circulation.

The present disclosure addresses the need for providing continuous fluid circulation during interruptions in drilling.

SUMMARY OF THE DISCLOSURE

In one aspect, the present disclosure provides an apparatus for continuously flowing drilling fluid along a drill string that is being manipulated. The apparatus may include a continuous circulation device having at least a first fluid path in fluid communication with a top drive and a second fluid path in communication with a diverter. The diverter is in selective fluid communication with a pipe stand associated with the drills string. The apparatus also includes at least one sensor that estimates at least one operating parameter associated with the continuous circulation device.

In another aspect, the present disclosure provides a method for using a continuous circulation device. The method may include using the continuous circulating device to manipulate the drill string and controlling the continuous circulation device using at least one sensor configured to estimate at least one operating parameter associated with the continuous circulation device.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

The present disclosure provides continuous circulation systems that measure one or more operating parameters to safely and efficiently manipulate the drill string; e.g., add drill pipe to or remove drill pipe from a drill string. In certain embodiments, the operating parameters may include environmental and/or position information. This information may be used to ensure that fluid connections are made-up or broken only when pressures are within prescribed ranges and moving components are in their proper alignment. Illustrative embodiments according to the present disclosure are described below.

Figure 1:
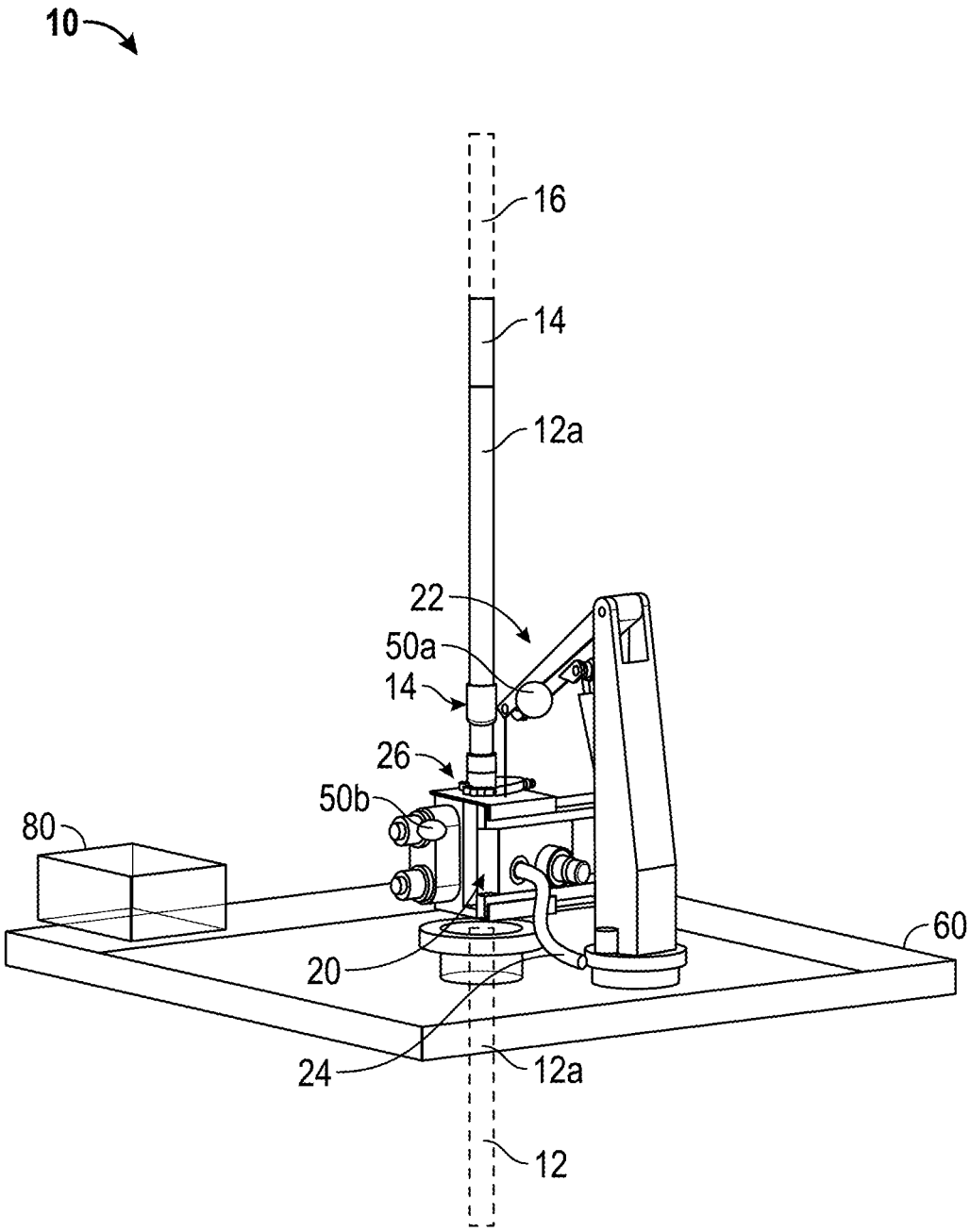
FIG. 1 isometrically illustrates a continuous circulation system that uses valves interconnected with drill stands in accordance with one embodiment of the present disclosure.

Referring to FIG. 1, there is shown one embodiment of a continuous circulation system 10 (CCS 10) according to the present disclosure for manipulating drill string while maintaining drill mud circulation. The CCS 10 includes a fluid circuit that includes at least two fluid paths that may be used to circulate drilling mud along a drill string 12. The CCS 10 can selectively switch fluid flow between these two fluid paths to maintain continuous fluid circulation in the drill string 12 as pipe stands 12*a* are added to or removed from the drill string 12. The drill string 12 may be formed of pipe stands 12*a*. Each pipe stand 12*a* may be formed of multiple pipe joints. The pipe stands 12*a* are interconnected by valves 14. A top drive 16, (not shown), may be used to rotate and displace the drill string 12 in a wellbore (not shown). The top drive 16 is configured in a conventional manner to direct fluid into the uppermost end of the drill string 12. The fluid path via the top drive 16 is the primary fluid path into the drill string 12. The valves 14 are part of the second fluid path into the drill string 12.

In one embodiment, the system 10 may use a diverter to bypass the top drive 16 and pump fluid directly into the drill string 12. The diverter may be a valve control device 20 that is moved by an arm 22. A fluid line 24 connects a source (not shown) for drilling fluid to a circulation adapter (FIG. 2) associated with the valve control device 20. The circulation adapter can selectively supply the valve 14 with pressurized drilling fluid while the top drive and a pipe stand 12*a* are disconnected.

Figure 2:
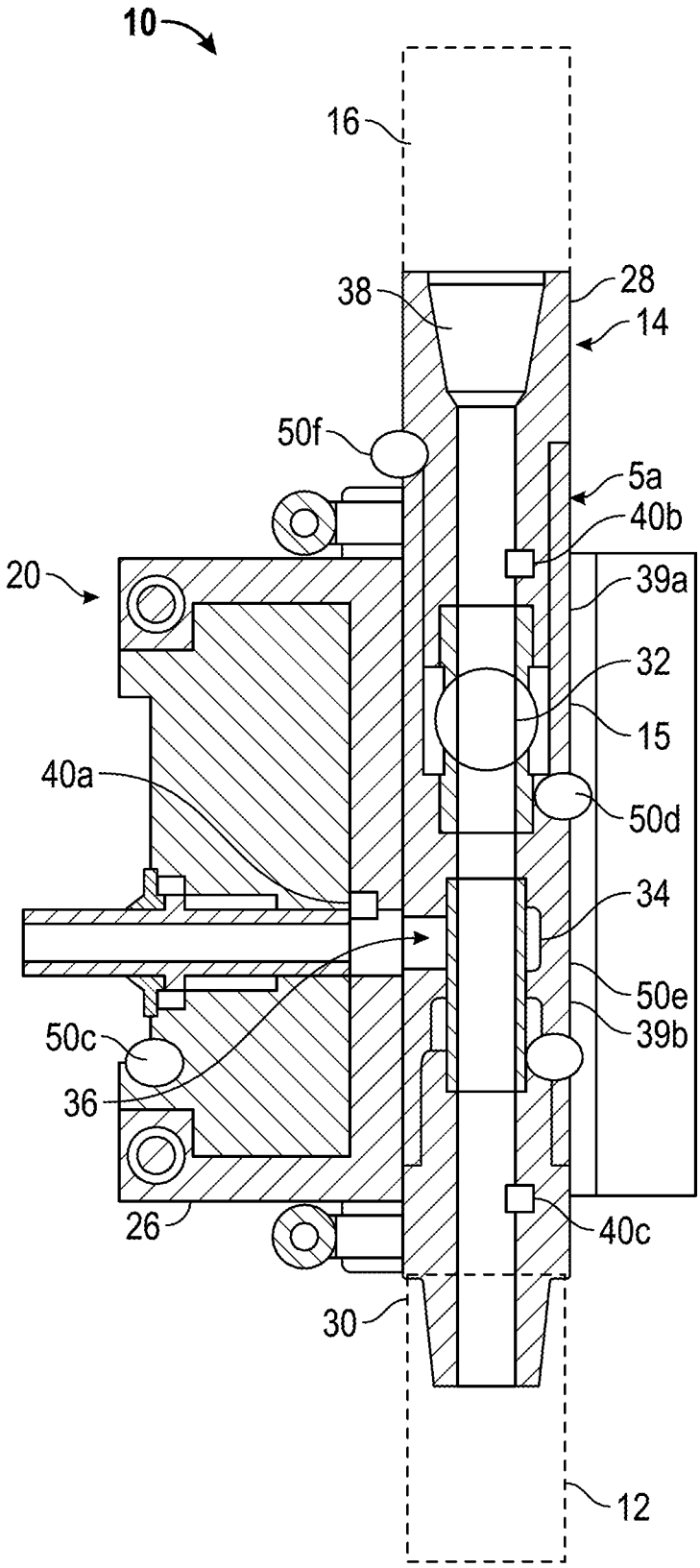
FIG. 2 sectionally illustrates a valve control device and a valve made in accordance with one embodiment of the present disclosure.

Referring to FIG. 2, there is shown a valve control device 20 that is operatively engaging the valve 14. As shown, the top drive 16 has drilled the drill string 12 into the wellbore (not shown) to a point that another pipe stand must be added to the drill string 12 for continued drilling. The valve 14 includes an upper end 28 and a lower end 30. The valve 14 may be fitted with flow control devices that allow fluid communication to the lower end 30 via either the upper end 28 or a lateral opening. In one embodiment, the valve 14 may include an upper circulation valve 32, a lower circulation valve 34, and an inlet 36. The upper circulation valve 32 selectively blocks flow along the bore 38 connecting the upper and lower ends 28, 30. The lower circulation valve 34 selectively blocks flow between the bore 38 and the inlet 36. The valve control device 20 includes an upper valve actuator 39*a* that can shift the upper circulation valve 32 between an open and a closed position and a lower valve actuator 39*b* that can shift the lower circulation valve 34 between an open and a closed position. It should be appreciated that the CCS 10 has two separate fluid paths that can independently circulate drilling fluid into the drill string 12, which then flows into the wellbore (not shown). The first fluid path is formed when the upper circulation valve 32 is open and the lower circulation valve 34 is closed. In this flow path, drilling fluid flows along the bore 38 from the upper end 28 to the lower end 30. The second fluid path is formed when the upper circulation valve 32 is closed and the lower circulation valve 34 is open. In this flow path, the drilling fluid flows along from the line 24 (FIG. 1), across the inlet 36, into the bore 38, and down to the lower end 30.

The CCS 10 may include sensors or instruments that provide information relating to one or more operating parameters relating to the internal conditions of the CCS 10. This information may be used by human operators to ensure that making up and breaking pipe connections occurs only under predetermined conditions; e.g., below a specified pressure or flow rate. Alternatively, a programmable controller may use this information to partially or fully automate the operation of the CCS 10. Illustrative sensors for obtaining operating parameter information are discussed below.

To monitor the environmental conditions of equipment such as the valves 32, 34, the system may include one or more pressure sensors 40*a-c*. For example, a pressure sensor 40*a* may be used to sense a pressure at the inlet 36, a pressure sensor 40*b* may be used to sense a pressure along the bore 38 at a location between the upper circulation valve 32 and the upper end 28, and a pressure sensor 40*c* may be used to sense a pressure along the bore 38 at a location between the lower circulation valve 34 and the lower end 30. In one embodiment, the pressure sensors 40*b,c* may be embedded in a body 15 of the valve 14. The embedded pressure sensors 40*b,c* may transmit data and /or power using an inductive coupling. Alternatively, the embedded pressure sensors 40*b,c* may include data conductors (not shown) that include terminals (not shown) on accessible outer surface of the body 15. Suitable pressure sensors include, but are not limited to, pressure transducers, piezoelectric devices, electromagnetic devices, capacitive devices, potentiometric devices, etc.

To monitor the position of equipment, the system 10 may include one or more position sensors 50*a-f*. As used herein, the term "position" refers to a relative position between two or more objects, an absolute position relative to a reference frame, an alignment, a location, or an orientation. Illustrative position sensors include, but are not limited to linear position sensors, rotational position, contact sensors, acoustic sensors, LVDT-type sensors, and inductive proximity sensors. In certain arrangements, the system may include a position sensor 50*a* (FIG. 1) to determine the position of the arm 22 (FIG. 1), position sensor 50*b* (FIG. 1) to determine the position of the valve control device 20, position sensor 50*c* to determine the position of the circulation adapter 26, position sensors 50*d,e* may be used to determine the position of the valve actuators 39*a*, 39*b*, and position sensor 50*f* may be used to determine the position of the valve 14. It should be understood that the identified positions sensors 50*a-f* are merely illustrative in nature and that position sensors may be used in connection with other devices associated with the CCS 10.

Referring now to FIGS. 1 and 2, in one illustrative mode of operation, a system such as the top drive 16 may be used to progress the drill string 12 into the wellbore until the valve 14 is proximate to the drill floor 60. This step in the operation is illustrated in FIG. 2 wherein the top drive 16 is shown as positioned just above the valve control device 20. Next, the arm 22 moves the valve control device 20 into engagement with the valve 14. This engagement may involve the interaction between several components of valve control device 20 and the valve 14. For example, the valve inlet 36 is aligned with the circulation adapter 26, the upper circulation valve 32 is operatively connected to an upper valve actuator 39*a*, and the lower circulation valve 34 is operatively connected to a lower valve actuator 39*b*. The position sensors 50*a-f* may be used to verify that these moving components and connections are properly aligned with one another.

During the above-described process, drilling fluid is still circulated through the top drive 16 and along the valve 14 via the upper end 28. The pressure associated with this flow may be sensed by the pressure sensor 40*b*. Next, the circulation adapter 26 is inserted into a side inlet 36 in the valve 20. After the fluid line 24 is pressurized with drilling mud, the lower valve actuator 39*b* actuates the lower circulation valve 32 to the open position, e.g., by axial or rotational motion. The pressure sensor 40*a* may be used to determine when the pressure in the fluid line 24 is sufficiently high to actuate the lower circulation valve 32. Now, drilling fluid may flow through the side inlet 36 into the bore 38. At this point, drilling fluid is circulated through the top drive 16 and through the valve control unit 20 and side inlet 36.

To hydraulically isolate fluid flow from the top drive 16, the upper valve actuator 39*a* actuates the upper circulation valve 32. The upper circulation valve 32 hydraulically seals the upper end 28 from the lower end 30. Thus, drilling fluid circulates only through the side inlet 36. The pressure sensors 40*a* and 40*c* may be used to ensure that the drilling mud is circulating properly.

The bore 38 uphole of the upper circulation valve 32 is now depressurized. The pressure sensor 40*b* may be used to monitor this depressurizing and identify when the pressure has sufficiently dropped to a point where the valve 14 may be decoupled from the top drive 16.

After the top drive 16 is disconnected from the valve 14, a new joint or stand of drill pipe 12*a*, which also has a valve at one end, is connected to the drill string 12 and the top drive 16 is connected to the valve of the new pipe stand 12*a* as generally shown in FIG. 1. At this stage, a pressure above the valve 14 and the upper circulation valve 32 through the top drive 16 is re-established. The upper valve actuator 39*a* actuates the upper circulation valve 32 to an open position and the lower circulation valve 34 is closed using the lower valve actuator 39*b*. Again, the pressure sensor 40*b* may be used to monitor the pressure in the bore 38 and determine when the pressure is sufficiently high to open the upper circulation valve 32. The pressure sensor 40*a* may be used to monitor the pressure at the inlet 36 and determine when the pressure is sufficiently high to close the lower circulation valve 34. Then, the circulation through the fluid line 24 is stopped. After the pressure sensor 40*a* indicates that the pressure in line 24 is below a desired value, the circulation adapter 26 may be disconnected from the inlet 36 and the valve actuators 39*a*, 39*b* may be decoupled from their respective valves 32, 34. At this point, the valve control device 20 may be moved away from the drill string.

It should be appreciated that the position sensors 50*a-f* may be used to ensure that the moving components of the system 10 properly align with one another and also with the valve 14 during the above-described operation. That is, prior to or after the mechanical interactions described above (e.g., axial or rotational movement, physical connections/disconnections, fluid connections/disconnections), these position sensors 40*a-c* may provide information as to whether a particular component device is positioned as intended.

In some embodiments, the information obtained by the pressure sensors 40*a-c* and the position sensors 50*a-f* may be transmitted to a controller 80. The controller 80 may display the pressure and/or position information to a human operator. In other embodiments, the controller 80 may include one or more processes and memory modules that include algorithms and programs for semi-automated or fully automated operation. For example, the controller 80 may use the information from the pressure sensors 40*a-c* and position sensors 50*a-f*, as well as other information relating to the system 10, to automatically add pipe to or remove pipe from the drill string 12.

It should be understood that the teachings of the present disclosure are not limited to any particular continuous circulation system. While FIGS. 1 and 2 illustrate a continuous circulation system that used valves positioned between pipe stands, other continuous circulation systems do not use such valves. Nevertheless, the present teachings may be readily applied to such systems as discussed below.

Figure 3:
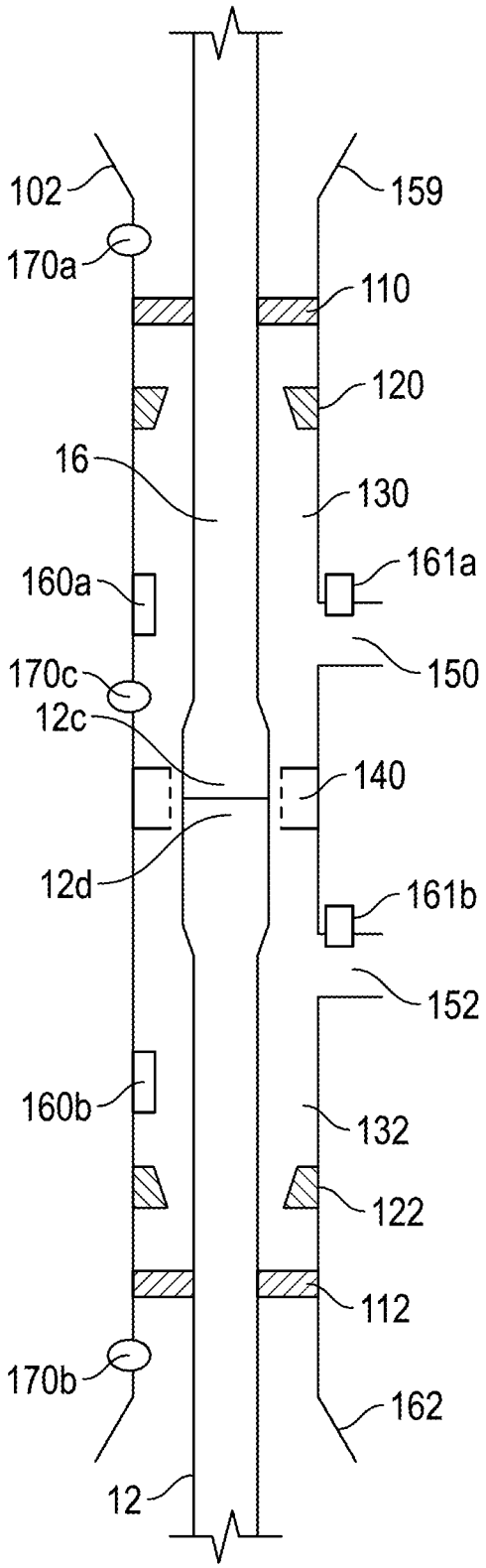
FIG. 3 sectionally illustrates a continuous circulation system that uses a circulation sub in accordance with one embodiment of the present disclosure.

FIG. 3 illustrates another continuous circulation system 100 (CCS 100) for maintaining a continuous flow of drilling fluid in a drill string 12 that is manipulated in some manner. The drill string 12 is shown connected to a top drive 16 at a pin-box connection 12*b*. As before, the drill string 12 is formed of pipe stands 12*a*, which also use similar pin-box connections.

In one embodiment, the system may include a diverter that can selectively bypass the top drive 16 and flow drilling fluid directly into the drill string 12. The diverter may be a circulation sub 102 ("sub 102") that surrounds and encloses a portion of the drill string 12. The sub 102 includes upper and lower seals 110, 112, upper and lower anchors 120, 122, upper and lower chambers 130, 132, and an intermediate isolator valve 140. The sub 102 includes fluid passages 150, 152 that provide selective fluid communication with the upper and lower chambers 130, 132 respectively. Thus the CCS 100 also has two fluid paths for flow fluid to the drill string 12. A first path is through the top drive 16. The second path is through the fluid passages 150, 152 of the sub 102.

The upper seal 110 is disposed at an upper opening 159 of the sub 102 and the lower seal 112 is disposed at a lower opening 162 in the body 12. The seal material is selected to enable a seal at working pressure despite variances in a diameter of the drill string 12. Moreover, the seals 110, 112 are configured to allow movement of the drill string 12, both axially and rotationally, while the seal is formed.

The upper locking anchor 120 is arranged below the upper seal 110 and the lower locking anchor 122 is arranged above the lower seal 112. The locking anchors 120, 122 are arranged to allow free axial movement of the drill string 12 when in the collapsed position. When the locking anchors 120, 122 are activated, the pin end 12*c* of the drill string 12*a* lands on and cannot pass through the upper locking member 120 and the box end 12*d* of the drill string 12*a* lands on and cannot pass through the lower locking member 122.

The upper pressure chamber 130 is formed between the upper locking anchor 120 and the isolator valve 140. The lower pressure chamber 132 is formed between the lower locking anchor 122 and the isolator valve 140. The isolator valve 140 is configured to selectively hydraulically isolate the upper chamber 130 from the lower chamber 132. Further, the valve 140 is configured to be radially retractable in order to allow passage of the drill string 12.

To monitor the environmental conditions of equipment inside the CCS 100, the system may include one or more pressure sensors 160*a-b*. For example, a pressure sensor 160*a* may sense pressure at the upper chamber 130 and a pressure sensor 160*b* may sense pressure at the lower chamber 132. These pressure sensors 160*a,b* may be used to ensure that the upper and lower chambers 130,132 are at a prescribed pressure (e.g., atmospheric pressure (~15 psi/1 bar)) before depressurizing either of the sealing elements 110, 112. Also, these pressure sensors may provide an indication that the upper and lower chambers 130, 132 are at substantially equal pressure before opening valve 140. Other environmental sensors may include flow sensors 161*a-b*. For example, a flow sensor 161*a* may be used to estimate a fluid flow rate along the fluid port 150 and a flow rate sensor 161*b* may be used to estimate a flow rate along the fluid port 152. Along with flow sensors located elsewhere at the rig or in the wellbore, these environmental sensors can also provide information indicative of out-of-norm conditions, such as drilling fluid losses (lost circulation) and formation fluid influx (kick or blowout).

To monitor the position of equipment, the CCS 100 may include one or more position sensors 170*a-c*. For example, a position sensor 170*a* may provide an indication of the position of the top drive 16 and a position sensor 170*b* may provide an indication of the position of the lower pipe stand 12*a*. Further, a position sensor 170*c* may be used to determine the position of the pin-box connection 12*b*. These position sensors 170*a-c* may be used to determine the position of the top drive 16 and drill stands 12*a* relative to the sub 102 and/or one another within the chambers 130, 132.

Figure 4A:
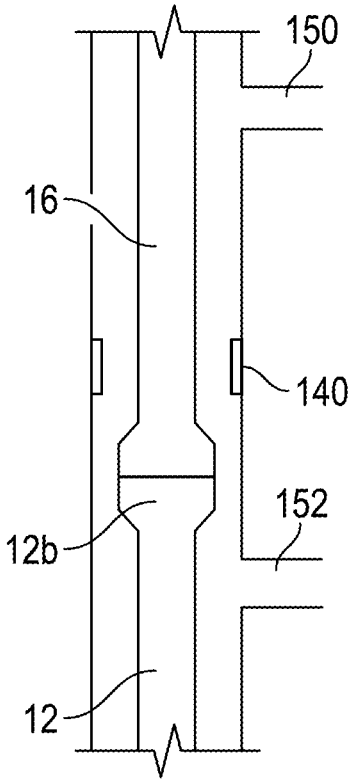
FIGS. 4*a-c* schematically illustrate a drill string manipulated by a top drive during use of a continuous circulation system in accordance with one embodiment of the present disclosure.

Referring now to FIGS. 3 and 4A-C, in an illustrative mode of operation, the CCS 100 is initially in a neutral position where the seals and valves are open and thereby minimally restrict the movement of the drill string 12 along the sub 102. The top drive 16 drives the drill string 12 downward toward the drill rig floor (not shown) until the pin-box connection is inside the sub 102. The information provided by the position sensors 170*a-c* may be used during this positioning process. Next, slips (not shown) may be used to engage and secure the drill string 12 to prevent axial movement. The sub 102 may be moved or shifted as needed to allow access for pipe handling devices such as an iron roughneck, rig tongs, and other torque tools. The pipe handling tools may be used to loosen and partially disconnect the pin-box connection 12*b*. Thereafter, the pipe handling tool device may be moved away and the sub 102 may be moved such that the pin-box connection 12*b* is just below the valve 140 as shown in FIG. 4A. Again, the position sensors 170*a-c* may be used during this positioning step. Now, the locking anchors 120,122 may be engaged and the seal elements 110,112 may be pressurized to hydraulically isolate the chambers 130,132. The pin-box connection 12*b* may be completely disconnected.

Figure 4B:
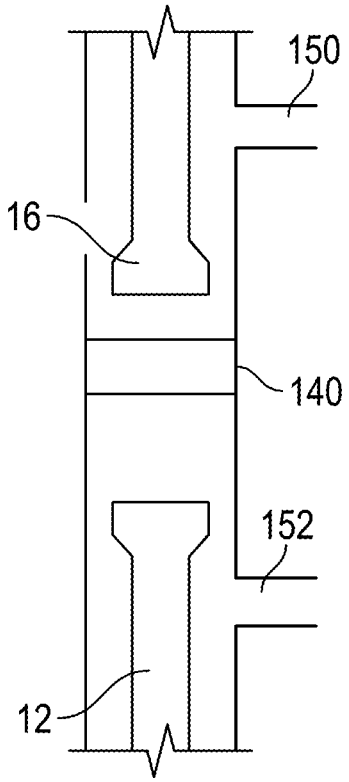

To begin diverting drilling mud, drilling mud is pumped into the lower chamber 132 via the fluid port 152 while drilling mud is still circulating through top drive 16 and the drill string 12. The top drive 16 is raised above the valve 140 and the fluid circulation is gradually transferred from the top drive 16 to fluid port 152 until there is no flow through top drive 16. During redirection of fluid flow, the pressure sensors 160*a,b* and the flow sensor 161*b* may be used to ensure that the switch-over of flow is proceeding as intended. The valve 140 may be actuated to a closed position, which hydraulically isolates the upper chamber 130 from the lower chamber 132 as shown in FIG. 4B. The pressure in the upper chamber 130 may be bled off by draining off the resident drilling fluid via the port 150.

Figure 4C:
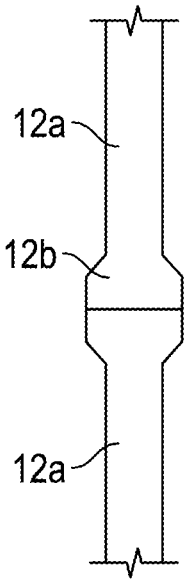

Once the sensor information indicates that the pressure in the upper chamber 130 is below a specified level, the upper locking mechanism 120 and the upper seal 110 may be actuated to an open position and the top drive 16 may be extracted from the sub 102. A new pipe stand may be connected to the top drive 16 and lowered into the upper chamber 130. As before, the position sensors 170*a-c* may be used during this positioning activity. The upper locking mechanism 120 and the upper seal 110 may be re-activated to seal the upper chamber 130. The upper chamber 130 may be filled with drilling fluid until the pressure sensors 160*a,b* indicate that there is substantially equal pressure between the upper and lower chambers 130 and 132. The valve 140 may be opened and the two pipe stands 12*a* may be connected to one another as shown in FIG. 4C. The upper and lower drill pipes 12*a* can be rotated to screw together to form the pin-box connection 12*b*. As drill pipe connection is being made up, fluid flow is gradually transferred from the fluid port 152 to the top drive 16 until there is no flow through the fluid port 152. Pressure may be bled off from the chambers 130, 132. After the environmental sensors 160*a,b*, and 161*a,b* indicate that pressure is below specified levels, the upper and lower locking mechanisms 120, 122 and the upper and lower seals 110, 112 may be deactivated.

The sub 102 may be raised to allow access for the pipe handling devices to apply a final torque to pin-box connection 12*b*. Finally, the slips (not shown) may be deactivated to release the drill string 12 and the sub 102 may be moved to a neutral position. Now, the drilling may continue.

Figure 5:
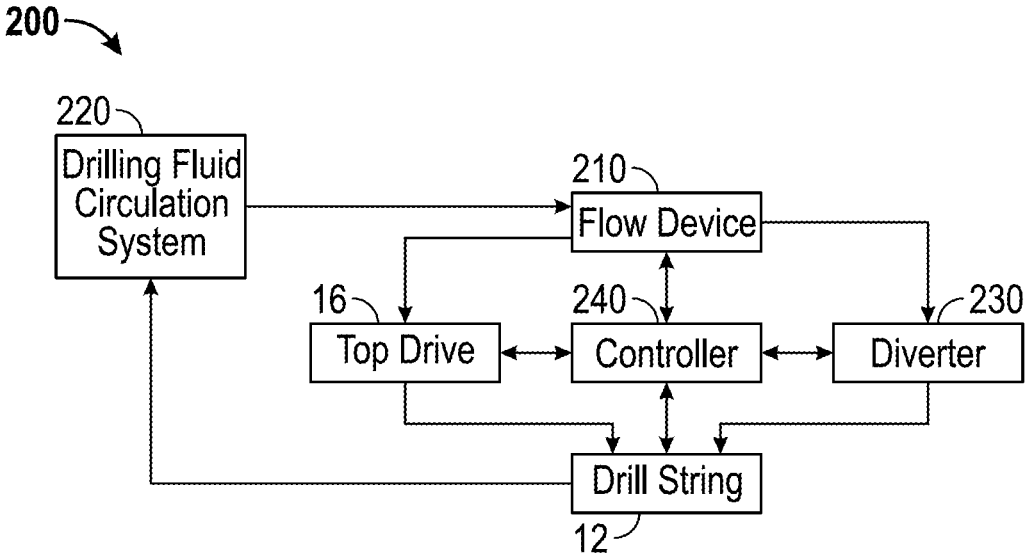
FIG. 5 illustrates in block-diagram format an automated continuous circulation system in accordance with one embodiment of the present disclosure.

Referring now to FIG. 5, there is shown one embodiment of a system 200 that includes a controller 240 programmed to control operations using environmental and position measurements. The system 200 may include a fluid control device 210 that receives fluid from a rig drilling fluid circulation system 220 and directs the drilling fluid to either or both of the top drive 16 or a diverter 230 (e.g., the valve control device 20 of FIG. 1 or the sub 102 of FIG. 3). In embodiments, the controller 240 may include processors with resident memory modules programmed with algorithms and instructions to make-up and break pipe connections according to preset sequence and only under specified conditions. For example, the controller 240 may be programmed to not deactivate the sealing elements 110, 112 (FIG. 3) if the pressure is above a preset value (e.g., greater than 15 psi) in either or both the upper and lower chambers 130, 132 (FIG. 3). The system may also include fluid diverters that safely divert high pressure spikes away from personnel.

Figure 6:
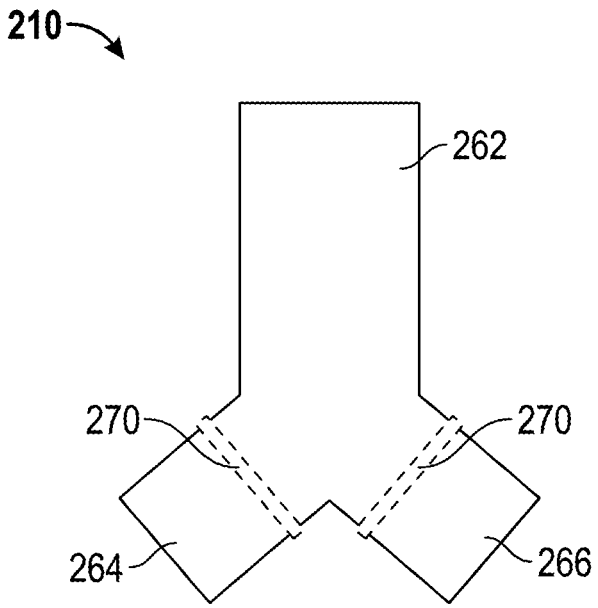
FIG. 6 schematically illustrates a fluid control device that can selectively switch fluid flow between the top drive and the diverter in accordance with one embodiment of the present disclosure.

Referring to FIG. 6, there is shown one embodiment of a fluid control device 210 that can selectively switch fluid flow between the top drive 16 (FIG. 1-3) and the diverter 230 (FIG. 5). The fluid control device 210 may be a Y-joint type of dual choke that receives a fluid flow from a fluid source such as a mud pump splits flow into two or more fluid paths. The fluid control device 210 may include an inlet 262, a top drive outlet 264 and a diverter outlet 266. Each of the outlets 264, 266 may include adjustable flow restriction elements 270 such as restrictor plates that can vary flow parameter such as flow rates in response to control signals. Referring to FIGS. 5 and 6, the controller 240 may be programmed to control the flow restriction elements 270 and thereby divert a precise percentage of the drilling fluid flow to either one or both fluid paths: i.e., the top drive 16 and/or the diverter 230. The fluid control device 210 may also include additional flow paths that may be used to vent or otherwise direct fluid; e.g., from the top drive 16 or the fluid passages 150, 152 (FIG. 3) of the sub 102 (FIG. 3).

It should be appreciated that the positions of these sensors are merely illustrative of the locations they may be positioned to acquire information useful to the operation of the systems 10, 100, and 200. Similarly, the types and locations of the environmental sensors are merely illustrative of the types of sensors and locations that may be used in the operation of the CCS 10, 100.

The top drive 16 is only a one non-limiting type of drill string control system that may be used to rotate and/or move the drill string 12.

While the foregoing disclosure is directed to the one mode embodiments of the disclosure, various modifications will be apparent to those skilled in the art. It is intended that all variations within the scope of the appended claims be embraced by the foregoing disclosure.

We claim:

1. An apparatus for continuously flowing drilling fluid along a drill string, comprising:

a continuous circulation device having at least a first fluid path in fluid communication with a top drive and a second fluid path in communication with a diverter in selective fluid communication with a pipe stand associated with the drills string;

a circulation sub configured to selectively isolate at least a portion of the pipe stand at a rig floor, the circulation sub receiving the drilling fluid from the diverter and including:

an upper hydraulic chamber, an upper port in selective fluid communication with the upper hydraulic chamber, a lower hydraulic chamber, and a lower port in selective fluid communication with the lower hydraulic chamber; and at least one pressure sensor in pressure communication with at least one of: (i) the upper hydraulic chamber, and (ii) the lower hydraulic chamber; and at least one flow rate sensor in fluid communication with at least one of (i) the upper port, and (ii) the lower port.

2. The apparatus of claim 1, wherein the continuous circulation device includes at least one sealing element configured to form a hydraulically isolated chamber in which at least a portion of the drill string is enclosed.

3. The apparatus of claim 1, further comprising a valve in which at least a portion of the first fluid path and the second fluid path are formed, wherein the valve includes an upper circulation valve that selectively closes the first fluid path and a lower circulation valve that selectively closes the second fluid path.

4. The apparatus of claim 3, further comprising a fluid circulation device configured to convey a drilling fluid through a fluid conduit that includes the first fluid path and the second fluid path.

5. A method for continuous flowing drilling fluid along a drill string, comprising:

manipulating the drill string using a continuous circulation device having at least a first fluid path in fluid communication with a top drive and a second fluid path in communication with a diverter in selective fluid communication with a pipe stand associated with the drill string; and controlling the continuous circulation device using at least one sensor configured to estimate at least one operating parameter associated with the continuous circulation device;

wherein the continuous circulation system includes a circulation sub configured to selectively isolate at least a portion of the pipe stand at the rig floor, the circulation sub including:

an upper hydraulic chamber, an upper port in selective fluid communication with the upper hydraulic chamber, a lower hydraulic chamber, and a lower port in selective fluid communication with the lower hydraulic chamber;

wherein the at least one sensor includes a pressure sensor in pressure communication with at least one of: (i) the upper hydraulic chamber, and (ii) the lower hydraulic chamber; and a flow rate sensor in fluid communication with at least one of (i) the upper port, and (ii) the lower port.

6. The method of claim 5, wherein the continuous circulation device includes at least one sealing element configured to form a hydraulically isolated chamber in which at least a portion of the drill string is enclosed.

7. The method of claim 5, wherein at least a portion of the first fluid path and the second fluid path are formed in a valve, wherein the valve includes an upper circulation valve that selectively closes the first fluid path and a lower circulation valve that selectively closes the second fluid path.

8. The method of claim 7, further comprising conveying a drilling fluid through a fluid conduit that includes the first fluid path and the second fluid path using a fluid circulation device.

9. An apparatus for continuously flowing drilling fluid along a drill string, comprising:

a continuous circulation device having at least a first fluid path in fluid communication with a top drive and a second fluid path in communication with a diverter in selective fluid communication with a pipe stand associated with the drills string;

at least one sensor configured to estimate at least one operating parameter associated with the continuous circulation device;

a circulation sub configured to selectively isolate at least a portion of the pipe stand at a rig floor, the circulation sub receiving the drilling fluid from the diverter and including:

an upper hydraulic chamber, an upper port in selective fluid communication with the upper hydraulic chamber, a lower hydraulic chamber, and a lower port in selective fluid communication with the lower hydraulic chamber, wherein the at least one sensor includes:

at least one pressure sensor in pressure communication with at least one of: (i) the upper hydraulic chamber, and (ii) the lower hydraulic chamber; and at least one flow rate sensor in fluid communication with at least one of (i) the upper port, and (ii) the lower port.

10. The apparatus of claim 9 wherein the at least one sensor further includes a position sensor providing an indication of a position of at least one of: (i) the top drive, (ii) a lower pipe stand, (iii) a position of a pin-box connection.

11. The apparatus of claim 10, further comprising a controller configured to control the circulation sub using measurements from the position sensor.

12. The apparatus of claim 9 further comprising:

a fluid control device that receives fluid from a rig drilling fluid circulation system; and a diverter in fluid communication with fluid circulation device, wherein the fluid control device selectively directs fluid flow to the top drive and the diverter.

* * * * *